US005379696A

United States Patent [19]

Boehme et al.

[11] Patent Number: 5,379,696

[45] Date of Patent: Jan. 10, 1995

[54] APPARATUS FOR CLEANING A ROLLER NIP IN ROTARY PRINTING MACHINES

[75] Inventors: Andreas Boehme, Bensheim; Peter Mayer, Muhlheim/Main; Arno Gärtner, Sinntal-Weiperz; Jurgen Heinen, Wiesbaden; Manfred Straub, Offenbach am Main, all of Germany

[73] Assignee: MAN Roland Druckmaschinen AG, Germany

[21] Appl. No.: 86,552

[22] Filed: Jul. 1, 1993

[30] Foreign Application Priority Data

Jul. 1, 1992 [DE] Germany ..... 4221527

[51] Int. Cl.[6] ..... B41F 35/00

[52] U.S. Cl. ..... 101/424; 101/425

[58] Field of Search ..... 101/424, 423, 425

[56] References Cited

U.S. PATENT DOCUMENTS

| | | | |
|---|---|---|---|
| 2,204,802 | 6/1940 | Gessler | 101/424.1 |
| 2,546,793 | 3/1951 | Sodomka | 101/142 |
| 3,355,324 | 11/1967 | Catzen | 101/425 |
| 4,480,548 | 11/1984 | Rebel et al. | 101/425 |
| 4,526,102 | 7/1985 | Grobman | 101/425 |
| 5,107,764 | 4/1992 | Gasparrini | 101/423 |
| 5,192,368 | 3/1993 | Harlizius | 101/425 |

FOREIGN PATENT DOCUMENTS

| | | | |
|---|---|---|---|
| 3220537A1 | 12/1983 | Germany . | |
| 3225564C2 | 8/1987 | Germany . | |
| 263264A1 | 12/1988 | Germany . | |
| 55-91592 | 2/1980 | Japan . | |
| 0004948 | 1/1988 | Japan | 101/425 |
| 2088284 | 6/1982 | United Kingdom | 101/425 |
| 8911924 | 12/1989 | WIPO | 101/425 |

OTHER PUBLICATIONS

"Automatic Blanket Cleaner, R300SV" Baldwin Apr. 1993 Baldwin's Advertising Flier.

*Primary Examiner*—Edgar S. Burr
*Assistant Examiner*—Anthony H. Nguyen
*Attorney, Agent, or Firm*—Leydig, Voit & Mayer, Ltd.

[57] ABSTRACT

An apparatus for cleaning a roller nip in rotary printing machines, which is filled with a fluid, includes at least one nozzle arranged above the liquid in the nip with the nozzle oriented at an angle ($\alpha$) with respect to the longitudinal direction of the nip so as to be directed towards the fluid. Blowing air is fed to the nozzle via a control valve and causes the fluid to flow along the nip and off at least one end of the rollers.

9 Claims, 4 Drawing Sheets

APPARATUS FOR CLEANING A ROLLER NIP IN ROTARY PRINTING MACHINES

FIELD OF THE INVENTION

The present invention relates generally to an apparatus for cleaning a roller nip of a rotary printing machine, the nip being formed by two rollers and being filled with fluid such as ink, varnish or working fluid.

BACKGROUND OF THE INVENTION

A prior art roller nip cleaning apparatus is described, for example, in JP 55-91515 (A). In this arrangement, the ink and washing fluid received in the nip is conveyed out of the nip via a roller rotating at different roller speeds and is scraped off by means of a stripping device.

Nips which are filled with a fluid, such as varnish, are also known, for example, from DE 3,225,564 C2.

DD-WP 263,264 A1 discloses a varnishing unit which possesses a blowing device arranged over the entire roller width and preferably directed onto the nip. This device serves for evaporating water from the varnish in order to increase the viscosity.

DE 3,220,537 A1 discloses a solution which dampens the roller surfaces by means of fluid feeds and which prevents ink or varnish from drying on during a press standstill or print cut-off. When a relatively large amount of fluid is fed, the fluid is returned into a collecting vessel.

It is known, furthermore, to clean roller nips manually. However, this is very complicated and subjective influences cannot be avoided.

A disadvantage of the solutions mentioned is that the nip receiving the fluid cannot be cleaned completely, since some residual fluid always remains in the nip and therefore cannot be prevented from drying on. In rollers which can be moved away from one another, there is the disadvantage of soiling the machine, since, when the roller is moved away, the residual fluid can flow out over the width of the nip. This is counteracted by carefully moving the rollers apart from one another and simultaneously sucking up the fluid with a cloth. However, this constitutes an impractical handling of the cleaning process.

OBJECTS AND SUMMARY OF THE INVENTION

The object of the present invention is to eliminate the disadvantages mentioned in the state of the art by providing a apparatus for cleaning fluid from a rollar nip in a rotary printing machine including a series of nozzles which are fed with a blast of air. The nozzles are located above and between the rollers and are directed at the nip at various orientations so as to convey the fluid along the nip in the lengthwise direction and off at least one end of the rollers.

The advantage of the apparatus according to the invention is that the cleaning process, for example in varnishing units, is automated. The cleaning of the rollers becomes simpler, and subjective influences including the risk of a soiling of the machine are prevented. The undesirable drying of ink or lacquer on the roller surface is thus avoided.

The invention is explained in more detail by means of an exemplary embodiment.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
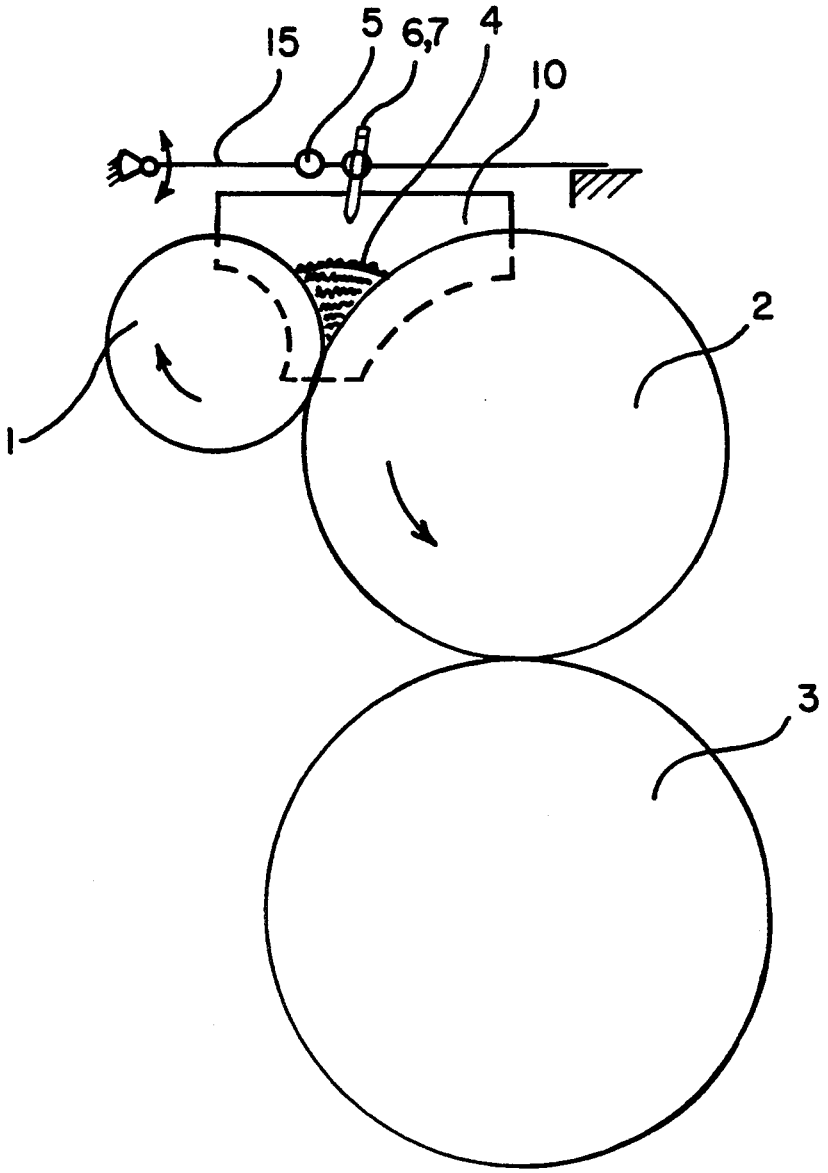
FIG. 1 is a general schematic side view of a varnishing unit to be cleaned.

Turning now to the drawings, FIG. 1 illustrates diagrammatically a varnishing apparatus which consists of a metering roller 1 with an applicator roller 2 engaging it and a form cylinder 3 following the applicator roller 2. A fluid indicated at 4, consisting of a varnish/water mixture, is located in the nip formed by the metering roller 1 and applicator roller 2 disposed in an axis parallel relation.

Above the fluid 4 are arranged a filling pipe 5 for feeding varnish or washing water and a cross member 6 extending parallel to the nip. In a preferred embodiment, the cross member 6 and filling pipe 5 are arranged on the machine entry guard 15 mounted pivotably above the nip.

Figure 2:
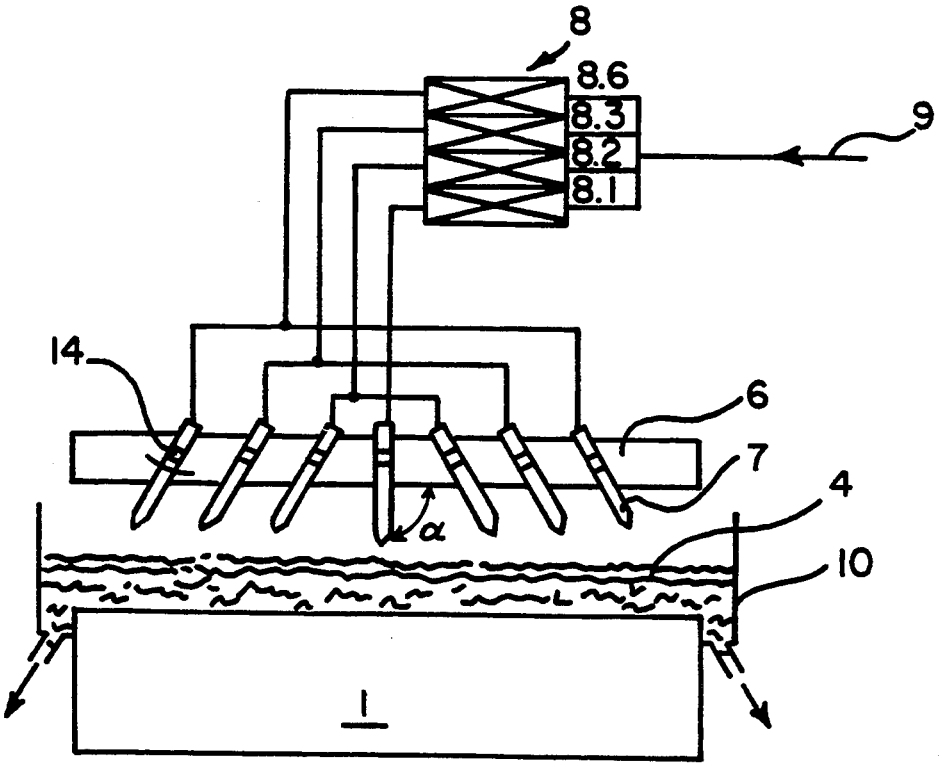
FIG. 2 is a schematic front view of a nozzle arrangement above the nip.

In FIG. 2, a plurality of nozzles 7 are attached along the cross member 6 with rotary joints 14 which allow the nozzles 7 to rotate through an angle ($\alpha$) up to 180° relative to the cross member 6. The nozzles 7 are coupled with a series of control valves 8 and are supplied with air under pressure from a suitable source through an air supply line 9. In a preferred embodiment, air from the supply line 9 is discharged through the nozzles 7 forcing the fluid 4 along the lengthwise direction of the nip toward at least one end of the rollers 1,2 and through one or both of the lateral ductors 10. As shown in FIG. 2 (and also in FIG. 6) each of the lateral ductors 10, located adjacent the opposite ends of the rollers 1 and 2, is preferably provided with a discharge opening 15 through which the fluid 4 may be caused to flow as indicated by the arrows D.

Figure 3:
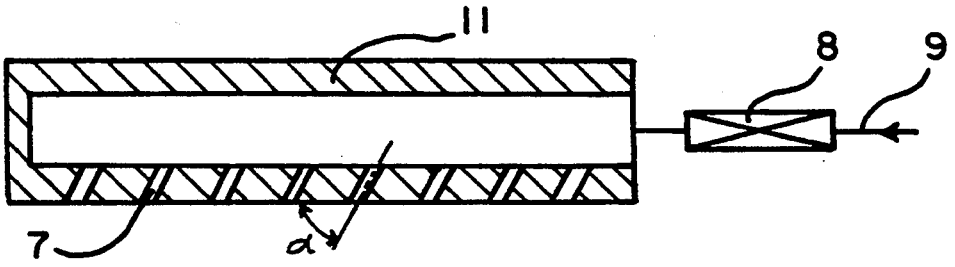
FIGS. 3 to 5 schematically illustrate examples of a nozzle arrangement integrated into a blowpipe.

In an alternative embodiment, as shown in FIG. 3, air from the supply line 9 is delivered through a control valve 8 and into a blowpipe 11 where it is discharged through the nozzles 7 which are all at the same fixed angle ($\alpha$) relative to the side of the blowpipe 11 and the nip of the rollers 1,2.

Figure 4:
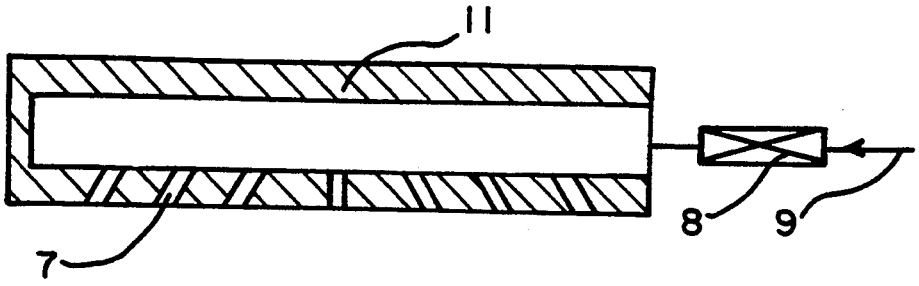

In the embodiment of FIG. 4, the nozzles 7 are likewise arranged in a blowpipe 11. Here, the center nozzle 7 is directed onto the nip at an angle $\alpha=90°$ relative to the side of the blowpipe 11. The other nozzles 7 are oriented at an angle ($\alpha$)=60° or 120° relative to the side of the blowpipe 11 depending on which side it is located in relation to the center nozzle 7. As in FIG. 3, the blowpipe 11 is coupled to a supply air line 9 via a control valve 8. The cleaning of the nip takes place by the flow-off of the fluid 4 towards both lateral ductors 10.

Figure 5:
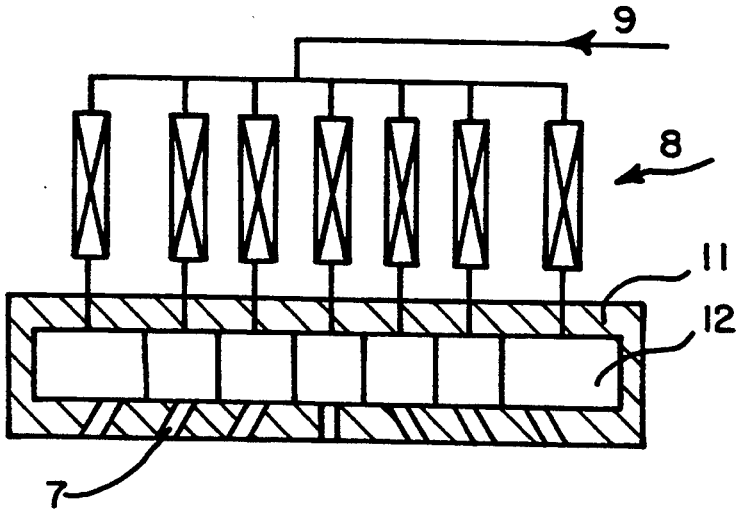

In FIG. 5, the nozzles 7 are arranged in a similar way to FIG. 4. Here, the blowpipe 11 has one associated air chamber 12 and control valve 8 for each nozzle 7. Each air chamber 12 and control valve 8 is connected to the air supply line 9. Through the use of the control valves 8, the nozzles 7 can be controlled in an individual switching sequence.

Figure 6:
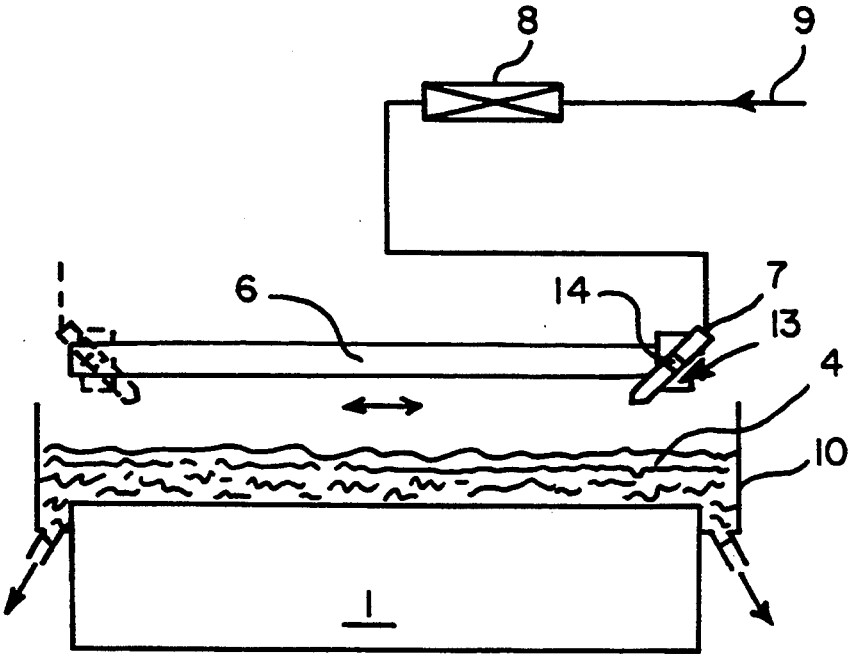
FIG. 6 is a schematic illustration of a linearly movable nozzle.

In FIG. 6, one or more linearly movable nozzles 7 are arranged on the cross member 6. The cross member 6 acts as a straight guide and has connected to it a linearly movable carrier 13. Preferably, the nozzles 7 are mounted on the carrier 13 with a rotary joint 14. A drive, not shown, moves the carrier 13 in a reciprocal fashion on the cross member 6. The nozzles 7 are inclined at an angle ($\alpha$) up to 180° relative to the movable carrier via the rotary joint 14. When the carrier 13 reaches either end position on the cross member 6, the angular orientation of the nozzles 7 and the linear movement of the carrier are reversed. The fluid 4 can thereby be guided alternatively out of the nip at the two lateral ductors 10.

We claim as our invention:

1. An air blast apparatus for removing fluid axially from a roller nip in a rotary printing machine, said nip being formed by two axis-parallel rollers engaging one another and having opposite ends, said fluid being confined in said nip by a pair of lateral ductors respectively located adjacent the opposite ends of said rollers and at least one of said lateral ductors having a discharge opening through which said fluid may be caused to flow, said air blast cleaning apparatus comprising, in combination, a plurality of air nozzles disposed above said nip and between said rollers and said lateral ductors, means including a source of air under pressure and a control valve coupled to said air nozzles for selectively discharging a blast of air therethrough, means for mounting and distributing said nozzles along the lengthwise direction of said nip between said lateral ductors, and means for orienting said nozzles at an angle ($\alpha$) relative to said lengthwise direction in order to direct said blast of air against said fluid and convey it along said nip in said lengthwise direction toward at least one end of said rollers and out through said discharge opening in said lateral ductor.

2. An air blast apparatus for removing fluid axially from a roller nip in a rotary printing machine as defined in claim 1, wherein said means for mounting said nozzles includes a cross member extending between said lateral ductors and above and axially parallel to said nip, and said means for orienting each of said plurality of nozzles includes a rotary joint whereby each of said nozzles is pivotable through an angle ($\alpha$) of up to 180°.

3. An air blast apparatus for removing fluid axially from a roller nip in a rotary printing machine as defined in claim 1, including a blowpipe extending axially parallel to said nip and said nozzles are housed in said blowpipe above said nip and between said lateral ductors.

4. An air blast apparatus for removing fluid axially from a roller nip in a rotary printing machine as defined claim 3, wherein said blowpipe includes a separate air chamber for each nozzle.

5. An air blast apparatus for removing fluid axially from a roller nip in a rotary printing machine as defined claim 3, wherein said nozzles are arranged in said blowpipe at an angle ($\alpha$)$<$90° relative to said lengthwise direction.

6. An air blast apparatus for removing fluid axially from a roller nip in a rotary printing machine as defined claim 3, wherein said nozzles in said blowpipe are inclined in one direction along the length thereof.

7. An air blast apparatus for removing fluid axially from a roller nip in a rotary printing machine as defined claim 3, wherein each of said lateral ductors has a discharge opening through which said fluid may be caused to flow and said nozzles in said blowpipe are inclined, starting from the middle, in opposite directions on both sides of the middle to convey said fluid along said nip toward said opposite ends of said rollers and out through said respective discharge openings in said lateral ductors.

8. An air blast apparatus for removing fluid axially from a roller nip in a rotary printing machine as defined claim 1, wherein said means for mounting said nozzles includes a cross member extending above and axially parallel to said nip and said means for orienting said nozzles includes carrier means mounted on said cross member for reciprocally moving at least one of said nozzles in said lengthwise direction along said nip.

9. An air blast apparatus for removing fluid axially from a roller nip in a rotary printing machine as defined claim 8, wherein said one nozzle is mounted on said carrier with a rotary joint and is adapted to reverse directions and inclinations with respect to said nip as said carrier means reverses directions at each end of said cross member.

* * * * *